United States Patent [19]

Eirich et al.

[11] Patent Number: 4,624,003

[45] Date of Patent: Nov. 18, 1986

[54] APPARATUS FOR HEATING ELECTRICALLY CONDUCTIVE BULK MATERIALS

[75] Inventors: Paul Eirich, Bahnhofstrasse 11; Walter Eirich, Spessartweg 18; Hubert Eirich, Sandweg 16, all of 6969 Hardheim; Erwin Goldschmidt, Hardheim, all of Fed. Rep. of Germany

[73] Assignees: Paul Eirich; Walter Eirich; Hubert Eirich, all of Hardheim, Fed. Rep. of Germany

[21] Appl. No.: 482,217

[22] Filed: Apr. 5, 1983

[30] Foreign Application Priority Data

Apr. 20, 1982 [DE] Fed. Rep. of Germany ..... 3214472

[51] Int. Cl.[4] ..... F27D 11/04; F27B 11/09; H05B 3/60

[52] U.S. Cl. ..... 373/120; 201/19; 219/284; 219/288; 373/29; 373/41; 373/115; 373/122

[58] Field of Search ..... 219/284, 288, 289; 201/19; 373/120–126, 27, 29, 36, 38, 41

[56] References Cited

U.S. PATENT DOCUMENTS

| | | | |
|---|---|---|---|
| 843,776 | 2/1907 | Taylor | 373/120 X |
| 884,563 | 4/1908 | Brimdley | 373/115 |
| 935,344 | 9/1909 | White | 373/120 |
| 1,013,189 | 1/1912 | Louvrier | 373/122 |
| 2,118,973 | 5/1938 | Hansgirg | 373/58 |
| 2,270,245 | 1/1942 | Barker | 373/123 X |
| 3,190,470 | 6/1965 | Ritter | 373/115 X |
| 4,082,543 | 4/1978 | Beggs et al. | 373/120 X |
| 4,261,857 | 4/1981 | Nakao | 373/120 X |

FOREIGN PATENT DOCUMENTS

| | | | |
|---|---|---|---|
| 626966 | 1/1963 | Belgium | 373/120 |
| 55700 | 3/1891 | Fed. Rep. of Germany | 373/122 |
| 474359 | 4/1929 | Fed. Rep. of Germany | 201/19 |
| 796169 | 1/1936 | France | 201/19 |
| 579056 | 7/1958 | Italy | 373/120 |

*Primary Examiner*—A. Bartis
*Attorney, Agent, or Firm*—Paul & Paul

[57] ABSTRACT

An apparatus for electrically heating conductive bulk materials by resistance Joule effect heating includes end and side walls defining an oven chamber having an inlet and an outlet. A plurality of pairs of generally planar electrode plates are angularly mounted with respect to the opposed end walls of the chamber and are electrically disconnected from one another. The electrode plates mounted to each end wall are disposed at the same angle and are arranged such that the upper edge of each electrode plate is at a different distance from the end wall than the lower edge of the plate, so that the planes of the plurality of electrode plates mounted to each end wall are substantially parallel and vertically displaced from each other. The electrical supply for each pair of electrodes plates is electrically isolated from that of each other pair. The amount of energy supplied to each pair of electrode plates is adjustable. The electrode plates may be provided with current conductor bars projecting from the planar surface of the bars into the bulk material. The extent to which the conductor bars extend into the material may be adjustable. A rotatable bulk material distributing plate may be provided at the chamber inlet. The chamber outlet may include a plurality of emptying apertures each provided with outlet cones.

19 Claims, 10 Drawing Figures

APPARATUS FOR HEATING ELECTRICALLY CONDUCTIVE BULK MATERIALS

Figure 1:
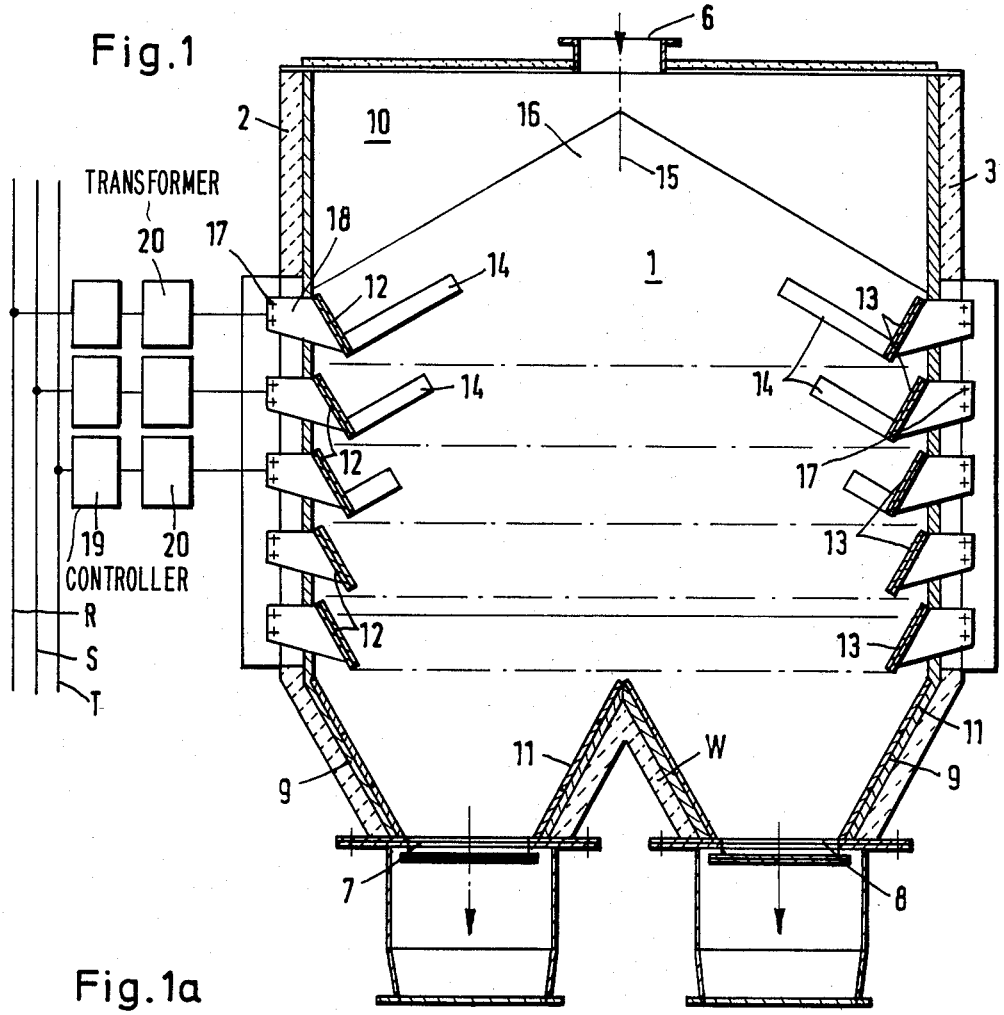

The invention relates to an apparatus for heating electrically conductive bulk materials by resistance heating, comprising an inlet, an outlet and, arranged between them, end and side walls forming an oven chamber, and comprising electrodes mounted on the end walls.

It is known to heat carbon containing raw materials in the production of electrode materials for the electrodes of electric smelting furnaces or the electrolyte material for the production of aluminium by fusion electrolysis. Particularly in the manufacture of high grade briquettes it is known for the starting material, such as coke, soot or coal, to be intimately mixed, provided with a thermoplastic binder, particularly pitch, and then pressed. To ensure that the compression moulds are adequately filled, it is desirable for the bulk material to be preheated, and resistance heated apparatuses of the above type are used for this purpose.

Electric ovens are known where the current passes horizontally through carbon materials and is supplied by means of electrodes suspended over rollers, the electrodes being withdrawn in an upward direction as the oven is gradually filled. This was in an attempt to heat the whole content of the oven as evenly as possible, but with the above-mentioned construction it involved a considerable mechanical outlay, with complicated provisions for the current supply. The heat was nevertheless not satisfactorily distributed, since a 12 hour rest period was considered necessary after charging.

A continuous oven with annular electrodes is known, where the current is passed through a single path through the coke. Although this makes it possible to have a smaller oven cross-section, the charge is reduced with an excessive increase in overall height, and continuous operation has not been achieved in practice, because most preparing machines operate not continuously but in batch production. Interpolated buffers are extremely complicated and expensive.

In DE-PS No. 15 71 443 a resistance heated oven has therefore been provided to equalise the heating action. In the construction of the oven the transverse dimension of the current path becomes smaller as the distance away from the electrode increases, as a means of equalising current density over the whole cross-section of the oven. However, there is the disadvantage here that the container has a very complex shape and is not only very expensive to produce but also makes it difficult to use modern, heat resistant and wear resistant materials, which are only supplied in certain standard formats, without considerable alterations. In particular subsequent finishing by traditional methods is hardly possible.

The invention therefore aims to improve an apparatus of the above type, while avoiding the disadvantages of the oven disclosed in DE-PS No. 15 71 443, so that the bulk material can be heated evenly and the geometrical shape of the oven chamber is nevertheless as simple as possible, thus enabling commercial materials to be used without special finishing.

According to the invention, this aim is achieved in that at least two pairs of electrodes are provided, fixed to opposed end walls and electrically disconnected from one another. In this way a plurality of electrically disconnected circuits are available, allowing for even supply and distribution of the current within the bulk material to be heated. Each particular pair of electrodes may be at the same or a different electric potential, so that a current path of one pair will scarcely have any effect on that of the other pair. The same applies when a plurality of pairs of electrodes are used. However, it is not only uniform heating of the bulk material that is obtained in this way; current breakthroughs are also advantageously avoided, thus preventing the formation of channels with the material of an increased temperature. The measures of the invention allow for the fact that the current passed through the bulk material always tends to go the way of least resistance, as is already known and stated in publications. Overheating of the bulk material at some places, namely near current filaments of low resistance with inadequate heating of adjacent portions of material can be avoided far better through equalisation by the method of the invention than with the complex oven construction of the known, resistance heated oven. There the side walls forming the oven chamber would have to be arranged so that the transverse dimension of the current path would decrease as its distance from the electrode increased. This is the only way to increase the probability of even current density over the whole cross-section of the oven. But it is clearly simpler to influence the current density by providing electrodes on the end walls of the oven chamber, while remaining independent in form and geometrical shape of the side walls and the end walls supporting the electrodes.

In another desirable embodiment of the invention the electrodes are provided at the preferably flat end walls of the oven chamber that are farthest removed from one another, the oven chamber being elongated in cross-section. In this way the oven chamber can be constructed not only in the simplest geometrical shape but also so as to form long current paths. The oven can nevertheless be fitted profitably and inexpensively in an entire installation and ordinary commercial materials can be used.

The electrodes may be made of graphite, metal or other suitable materials. In accordance with the invention they are desirably provided separately on an end wall, superimposed or juxtaposed, and the outlet preferably has two emptying apertures with outlet cones which touch one another substantially below the centre of the oven chamber. In practice the apparatus of the invention is generally constructed with the end and side walls rising substantially vertically, so that the inlet is at the top and the outlet at the bottom. In this case, when the oven chamber has been charged, bulk material will usually form a pouring cone, so that with a level discharge surface in the centre of the oven chamber there would be a larger cross-sectional area between the opposed pairs of electrodes. If two emptying apertures with outlet cones are juxtaposed as described, in accordance with the above-mentioned features of the invention, then the increase in cross-section in the oven charge in the centre of the oven cavity, caused by the above-mentioned pouring cone, will be compensated for, and the current density in the whole vessel for the current path flowing from one electrode to the one opposite will again advantageously remain the same.

In accordance with the invention the electrodes are thus located e.g. one above the other on one end wall and similarly on the opposite wall. As a means of preventing the current from flowing first through other adjacent electrodes instead of flowing directly into the heating material in difficult cases, it is desirable, according to the invention, for the electrodes to be plates which are arranged above and are adjacent one another like venetian blinds. Each electrode desirably comprises a plate elongated possibly in a horizontal direction, and the next electrode is arranged above or immediately below it in scale-like construction or as in the form of the individual slats of a venetian blind, thereby advantageously increasing the actual distance from one electrode to the adjacent one. However this prevents the abovementioned transverse flow of current through a plurality of electrode plates. In this way the current flowing from one electrode to another is forced into the various current paths, although the density of the bulk material is greater e.g. in the lower part of the oven chamber so that the bulk material also has better heat conductance in the lower region. The blind-like arrangement of the electrode plates enables the wall area to be fully utilised for the electrodes and forces the current along separate paths between the respective pairs of electrodes.

To ensure a uniform flow of current even under unfavourable conditions, e.g. where there is variation in the charging of the vessel, the density of the bulk material, its grain distribution and the like, it is particularly advantageous according to the invention for at least one electrode to be provided with a current conductor bar projecting into the oven chamber. This preferably projects transversely from the plate and thus from the end wall out into the bulk material. A particularly preferred arrangement is to have such current conductor bars in the upper region of the bulk material of lower density, looser depositing and particularly where there is a definite pouring cone. The flow of current can in fact be forced in the desired direction by these bars and individually distributed as desired for each particular case. The length, direction and size of the bar obviously play an important part, as will be explained later.

In a further embodiment of the invention it is therefore advantageous for the length and/or position of the conductor bars projecting from the electrode plates to be adjustable. It is also favourable if the angle at which the bars extend from the plates can be adjusted. For example, the adjustment of the angle and length of the conductor bar may depend on the bulk material. Before an apparatus according to the invention is put into operation, temperature readings can be taken in the bulk material to determine the optimum current distribution and arrangement of the current paths, which can be obtained by appropriate adjustment of the conductor bars.

By arranging and adjusting the direction and length of the conductor bars it is very easy, according to the invention, to take the flow of current in the oven chamber upwards into the pouring in cone and also into the layers of bulk material at low density. The bars are thus mounted and constructed in such a way that they can be adjusted according to individual requirements when the apparatus is put into operation.

The arrangement of the current conductor bars, possibly in conjunction with the blind-like arrangement of the electrode plates, further enables the container or the walls forming the oven chamber to have a simple geometrical shape. In this way the apparatus can easily be adapted to the often difficult installation conditions. Furthermore different sizes of apparatus of the same basic shape can be obtained by having more or less current carrying sections, which can be set up by vertically superimposing a plurality of electrodes.

With the above-mentioned use of two emptying apertures with outlet cones, a rectangular or square shape may be provided instead of a round cone for the truncated pyramid outlets, so that a cladding of slabs which are resistant to high temperatures and also particularly wear resistant may be provided, having in mind particularly the aluminium oxide ceramics which are now already commonly used in industry. This material, which is extremely wear resistant and insensitive to temperature, is only supplied in certain standard formats, and the measures according to the invention enable it to be used in any type of apparatus without any subsequent finishing being necessary.

The intensity of the current is of course adjustable and automatically controllable. It is desirable for each circuit to have a rotary current thyristor control means to control the intensity of the current and an isolating transformer for electric disconnection and voltage reduction. The apparatus of the invention may be operated with DC, AC or rotary current. Where DC current is used a rectifier is additionally fitted in each circuit, e.g. a rotary current rectifier.

Further according to the invention it is desirable for the electricity fed into the bulk material in the oven chamber to be jointly pre-adjustable for each pair of electrodes and/or for all the current paths together. The desired degree of heating can thus advantageously be preselected by prescribing the energy to be fed in (in kilowatt hours). There is a possibility of prescribing the energy for each current path separately or a total energy value for all current paths. As soon as the desired amount of current per path (in one case) and/or for the whole apparatus (in the other case) has been fed in, the appropriate path or the current supply to the whole apparatus is disconnected. The energy fed in may be measured e.g. by a rotary current meter with contact means and zero reset.

It may further be desirable, according to the invention, for an agitator to be provided in the oven chamber and/or a distributing plate at the inlet to the apparatus. The introduction and distribution of the electric current can then be encouraged when different grain sizes are present or when the bulk material to be heated is inadequately homogenised. The use of a distributing plate above the inlet may e.g. result in extremely even charging of the oven chamber, without the formation of the pouring in cone described above; this avoids the separation of coarse grains from fine ones which takes place in this connection.

In a further embodiment of the invention, if the walls forming the oven chamber are flat and are placed and mounted on weighing means, the apparatus according to the invention may be used directly as a weighing container. With continuous operation monitoring of the oven weight may be used to control the throughput and/or to control current supply.

Figure 1A:
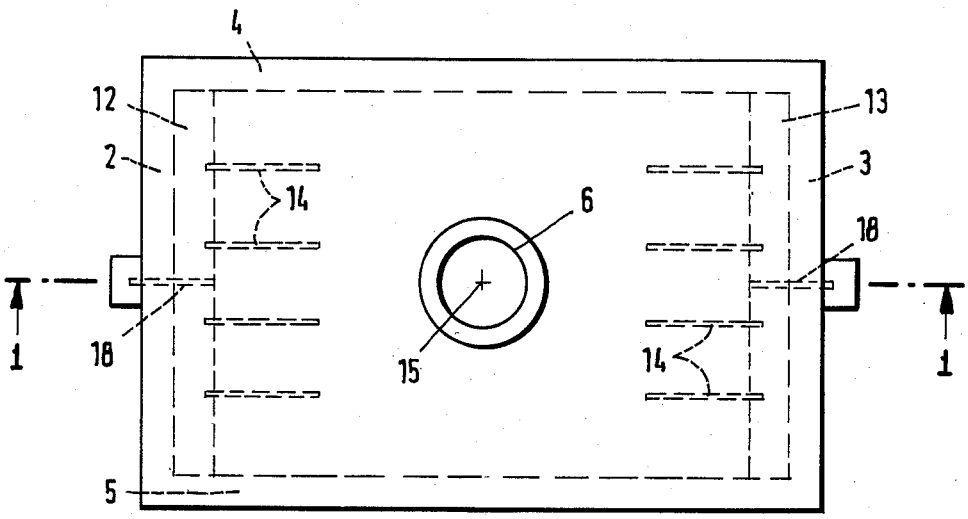

Other advantages, features and applications of the invention will emerge from the following description of preferred examples, in conjunction with the accompanying drawings in which:

FIG. 1 is a cross-section through the heating apparatus along line 1—1 in FIG. 1*a*.

Figure 1B:
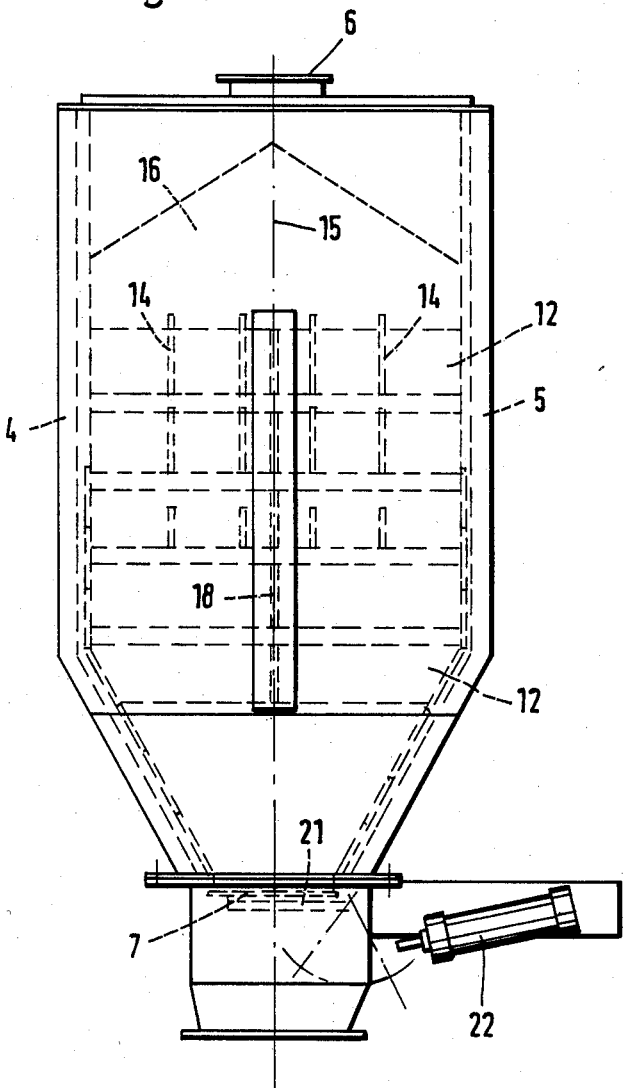
Figure 2:
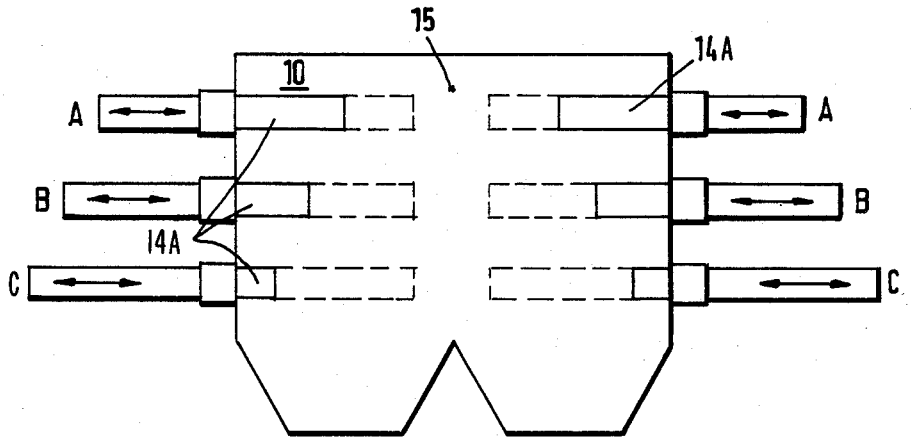
Figure 2A:
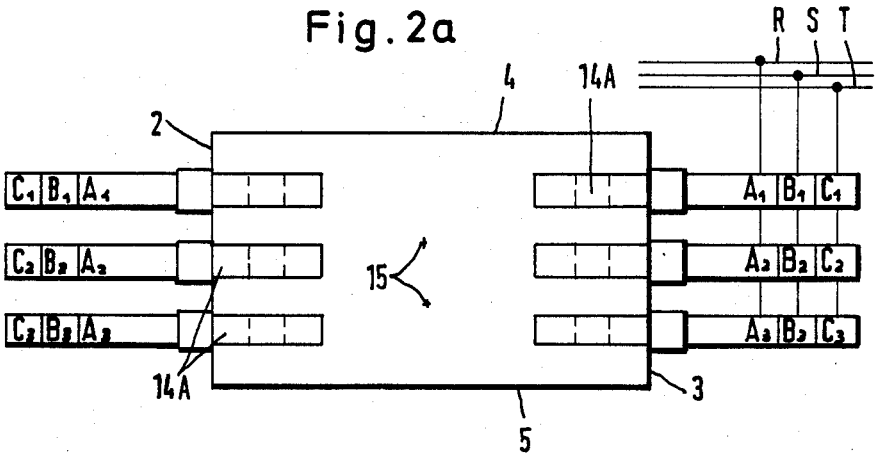
Figure 3:
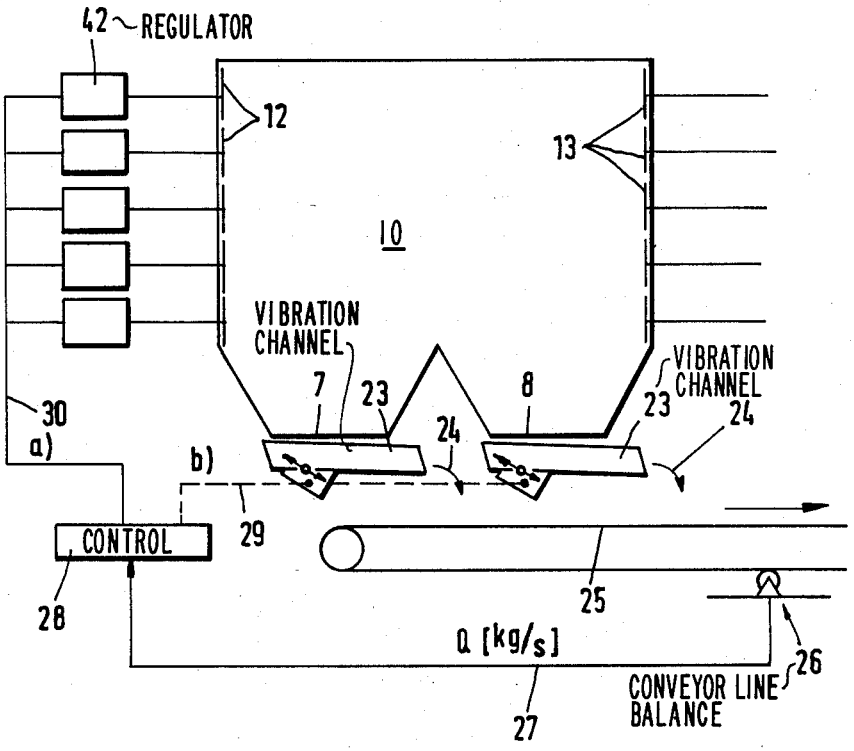
Figure 4:
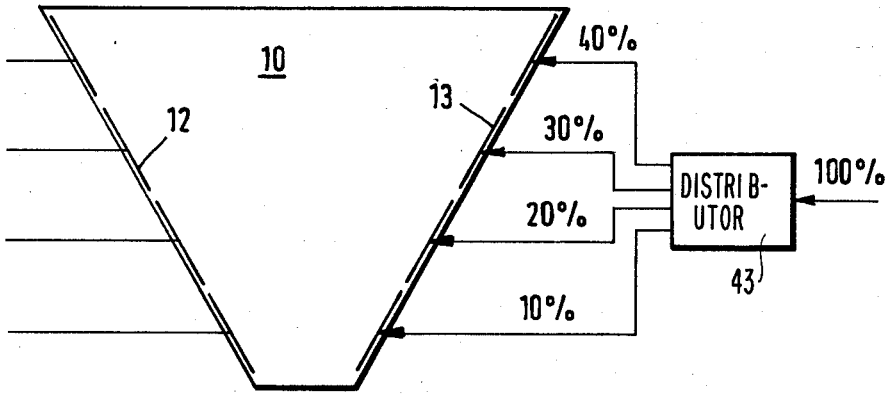
Figure 5:
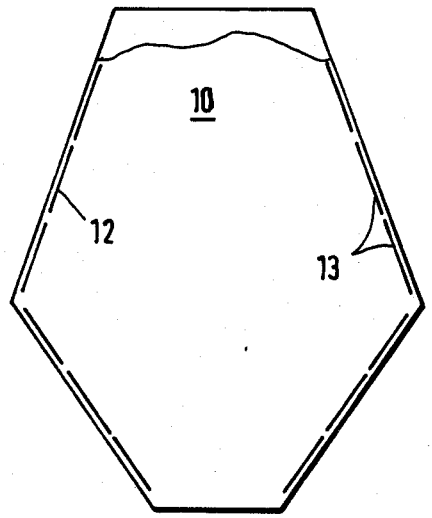
Figure 6:
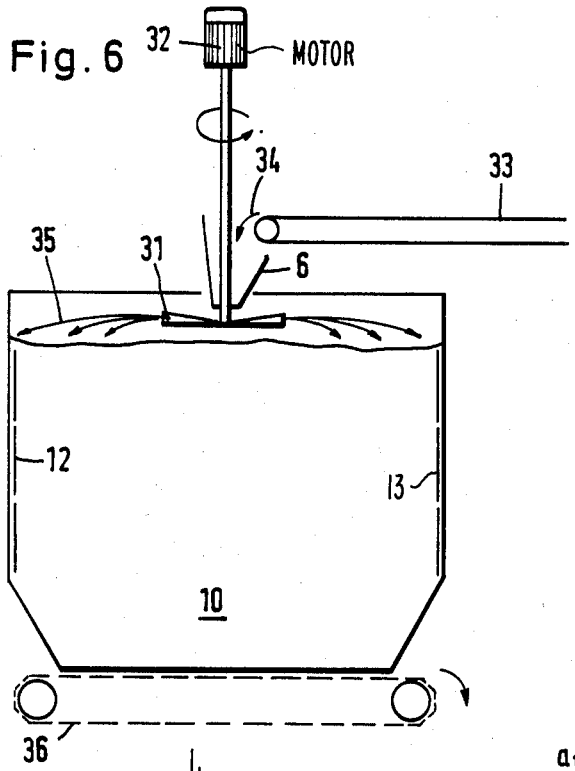
Figure 7:
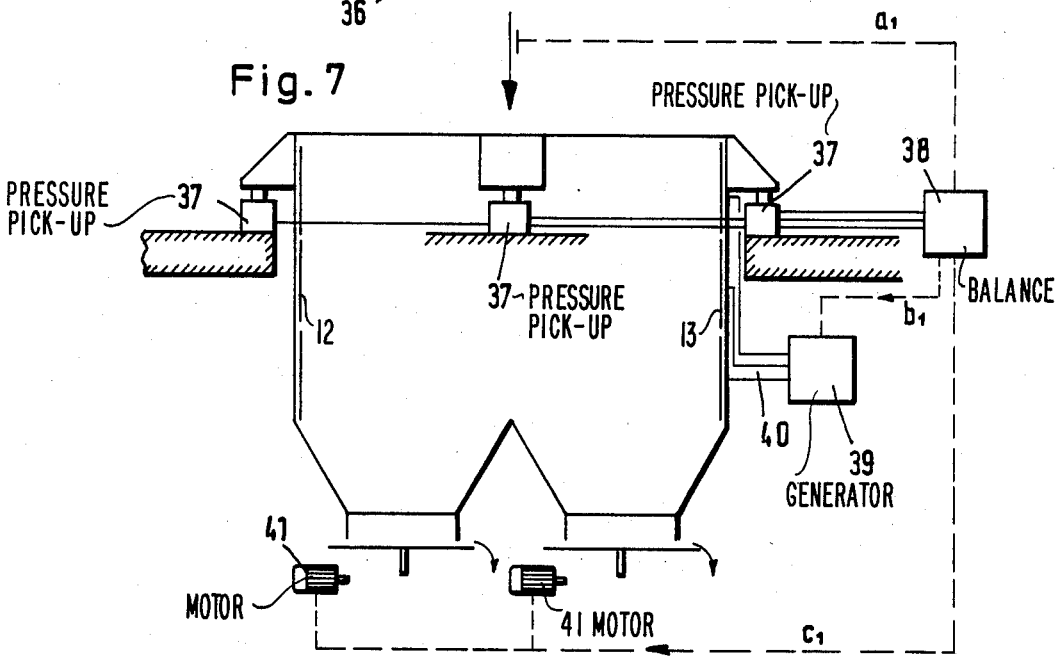

FIG. 1*a* is a plan view of the FIG. 1 apparatus,

FIG. 1*b* is a side elevational view of the FIG. 1 apparatus,

FIG. 2 is a diagram of a similar construction, with adjustable current conductor bars shown dipping in to different depts from the side, FIG. 2*a* is a view into the FIG. 2 apparatus from above, FIG. 3 is another diagram showing a similar construction of the apparatus, with discharge equipment and control means provided at the outlet, FIG. 4 shows another, different form of the oven chamber, with the apparatus being indicated diagrammatically, FIG. 5 shows yet another modification of the apparatus with its outlines indicated diagrammatically, FIG. 6 shows yet another embodiment of the apparatus, provided with a distributing plate at the inlet and with discharge means, and FIG. 7 shows schematically an apparatus constructed similarly to that in FIG. 1 but with its mount provided on a weighing device, with control means.

The apparatus for heating electrically conductive bulk material 1 is shown in FIG. 1, the end walls 2, 3, the side walls 4, 5, the inlet 6 and the emptying apertures 7, 8 with the discharge cones 9 being shown in conjunction with FIGS. 1*a* and 1*b*. The walls 2–5 forming the oven chamber 10 obviously have a steel skeleton with heat insulation on the outside and heat resistant insulating panels facing towards the oven chamber 10 on the inside. It will be seen that the portion in the region of the discharge cones 9 is clad with ceramic tiles 11.

The arrangement of five pairs of electrode plates 12 and 13 can be seen from FIGS. 1 and 1*b*. The plates are mechanically and electrically speaking completely separate from one another and are superimposed in the manner of venetian blinds. The upper three pairs of electrodes 12, 13 also have current conductor bars 14 extending into the oven chamber 10 and projecting into the bulk material 1 approximately perpendicularly to the inclined electrode plates 12 and 13. The plates are at an angle of 30° to 45° to the vertical, while the conductor bars 14 project approximately at right angles from them. It will seen that the top conductor bar 14, which is in the centre 15 and thus facing towards the pouring cone 16, is longer than the respective bar below it. The two bottom electrodes 12, 13 in FIG. 1 do not have conductor bars. This embodiment ensures that the upper electrode plates 12, 13, provided with the conductor bars 14, are present in a number divisible by three, so that three-phase current operation is preferably provided here. The electrical connections 17 are shown diagrammatically and located on supporting means 18 behind the electrode plates 12, 13. They allow for the supply of current and connection to the respective voltage of the electric leads RST, shown in FIG. 1, each connection being preceded by an AC controller 19 and a transformer 20.

It will be seen clearly from FIG. 1*b* that a plurality of conductor bars 14 are juxtaposed at a spacing on an electrode plate 12, and that at the bottom the outlet 7 is shut off by a closing flap 21, which is opened or closed by the hydraulic or pneumatic cylinder 22.

An apparatus of the same construction as the FIG. 1 is shown diagrammatically in FIG. 2. Its peculiarity, which can be seen in conjunction with FIG. 2*a*, is that the conductor bars 14 projecting from the electrode plates are adjustable. Three levels of electrode plates 12 and 13 (not shown) are indicated in FIG. 2, and the conductor bars 14A project substantially horizontally to different lengths. At the top level A the conductor bar 14 extends furthest towards the centre 15, while at the bottom level C the distance between the two bars 14A extending into the bulk material 1 is the greatest. Consequently the outwardly extending end at level C projects furthest to the rear. The broken lines indicate that the conductor bars 14A can be made to extend the same distance towards the centre 15 of the oven chamber 10 at all three levels A, B and C, depending on the desired position.

In FIG. 2*a* the connecting leads R, S and T are shown again, leading to the various electrodes, (not shown) and thus to the current conductor bars 14A. In FIG. 2*a* one is looking into the oven chamber 10 from above. One can therefore see, inside the walls 2–5, only the top conductor bars 14A with their front ends at the spacing predetermined thereby; at this the top level A the spacing is to be equal. The level B can be seen in broken lines, and the broken lines at the outside indicate the conductor bars 14A inserted at level C. The conductor bars correspondingly project towards the rear or outside the oven chamber 10 at levels B and C, and it is here assumed that three bars are provided at each level A, B and C, e.g. bars A1, A2 and A3 for level A.

FIG. 3 again shows a container shape similar to that in FIGS. 1 and 2, and the electrodes 12, 13 are shown diagrammatically as plates.

In this example vibration channels 23 are provided as discharge means below the emptying apertures 7 and 8, so that when the bulk material has been heated and has left the emptying apertures 7, 8 it drops onto a conveyor 25 in the direction of the arrows 24. Here the quantity of bulk material conveyed per unit of time can be sensed by the conveyor line balance 26 and passed along the lead 27 to a control 28. Depending on the priority chosen (chosen temperature or throughput) either the throughput of bulk material conveyed from the vibration channels 23—or generally from the discharge means—in the direction of the arrow 24, or the heating capacity of the current regulator may be controlled. Until the capacity limit or maximum capacity is reached the heating capacity may be controlled proportionally to the throughput. A control signal is passed to the current regulators 42 along the electric lead 30; and similarly the control commands are sent to the vibration channels 23 along the lead 29.

In FIG. 4 a different form of oven chamber 10 is shown, where the quantity of current can be adapted to the particular amount of material at the level in question. The percentages given, ranging from 10% at the bottom upwards to 40%, represent the distribution by distributor 43 of current conduction, e.g. from the right hand electrodes 13 to the left hand ones 12. This distribution must also correspond to the volume of material 1 arranged between them at the layer or level in question, a special current path being provided for each level as described above.

FIG. 5 shows another different embodiment of a container, with the electrode plates 12 merely indicated diagrammatically at the edge. The purpose of the biconical or bipyramid shape of the oven chamber 10 is to avoid the dead space created by the pouring in cone, which is largely done away with here.

A pouring-in cone can be completely avoided with the FIG. 6 embodiment, where a distributing plate 31 is driven by a motor 32 and arranged, with the oven chamber 10, substantially in the region of the inlet 6. The bulk material dropping to the left from the conveyor 33 in the direction of the arrow 34 therefore passes through the distributing plate 31, following paths substantially corresponding to the arrows 35, then fills the oven chamber 10 without any pouring in cone. The FIG. 6 container, like that in FIGS. 4 and 5, has only one emptying aperture at the bottom and when the bulk material has been heated it can be carried away, possibly by the discharge belt 36 in FIG. 6.

FIG. 7 finally shows a container shape like that in FIG. 1, but with provision to place the whole apparatus on pressure pick-ups 37, so that the oven can be used as the actual balance.

With continuous operation the monitoring of the oven weight may be used to control the throughput quantity and/or the current supply. The pressure pick-ups 37, from which the signals can be given to the balance 38, can be seen in FIG. 7. From here there is a signal along the lead $a_1$ to change the amount of material being charged, i.e. to control throughput. In addition or alternatively a control signal may pass along the lead $b_1$ to the electric generator 39, which controls the current supply along the leads 40 (phases RST). A control signal may further be sent along the lead $c_1$ to the discharge means including motor 41, enabling the amount discharged to be controlled at that location.

The apparatus of the invention may further by characterised in that a continuously controllable discharge means is provided, with the possibility of adapting its output to the heat output, which can be preset. In another alternative embodiment the apparatus may be characterised in that a control means for the heat output from a heater or for the electricity supplied can be adapted to the setting of the controllable discharge means. In other words, in the apparatus of the invention a continuously controllable discharge means and a control means for the electricity supply may be provided, the discharge and control means being mutually adaptable to one another.

Depending on the grade of product and its purpose, it may be desirable to provide either the continuously controllable discharge means or the control means for the electricity supply. If the requirement is e.g. to maintain a very constant temperature, then the throughput and amount discharge may be controlled so that all the material discharged is at the desired temperature.

We claim:

1. Apparatus for heating electrically conductive bulk materials by means of resistance heating, comprising an inlet, an outlet, and, arranged between them, end and side walls forming an oven chamber, and comprising at least two pairs of generally planar electrode plates mounted to opposed end walls and electrically disconnected from one another, the planes of a plurality of said electrode plates mounted to each wall being substantially parallel and vertically displaced from one another; isolating means, coupled to each pair of electrode plates, for isolating the electrical supply of each pair of electrode plates from each other pair; and means for adjusting the amount of electrical energy supplied to each pair of electrode plates.

2. The apparatus of claim 1, characterised in that the end walls of the oven chamber are those that are farthest removed form one another, the oven chamber being elongated in cross-section.

3. The apparatus of claim 1, characterised in that the outlet has two emptying apertures with outlet cones, which touch one another substantially below the centre of the oven chamber.

4. The apparatus of claim 1, characterised in that at least one electrode plate is provided with a current conductor bar projecting into the oven chamber.

5. The apparatus of claim 4, characterised in that the position of the current conductor bar projecting from the at least one electrode plate is adjustable.

6. The apparatus of claim 1, characterised in that means for uniformly distributing said bulk material is arranged at the inlet of the apparatus.

7. The apparatus of claim 6, wherein said means for uniformly distributing the bulk material comprises a distribution plate.

8. Apparatus for heating electrically conductive bulk materials by means of resistance heating comprising an inlet; an outlet; end and side walls, arranged between said inlet and said outlet, forming an oven chamber; at least two pairs of generally planar, generally rectangular electrodes, the members of each pair being mounted to opposed end walls, a plurality of said electrodes being displaced from said end walls toward the interior of said oven chamber, and a plurality of said electrodes being disposed at an angle with respect to the end walls to which they are mounted, such that the upper edge of each electrode is at a different distance from said wall than is the lower edge.

9. The apparatus of claim 8 wherein all of said electrodes are disposed at an angle with respect to the end walls.

10. The apparatus of claim 8 wherein the lower edge of each electrode disposed at an angle is at substantially the same height as the upper edge of any immediately adjacent lower electrode.

11. The apparatus of claim 8 wherein said walls are generally planar, and all angularly-disposed electrodes are disposed at the same angle.

12. The apparatus of claim 8 wherein said inlet is at the upper end of said oven chamber, said outlet is at the lower end of said oven chamber, and said outlet has a plurality of emptying apertures with outlet cones which touch one another substantially below the center of the oven chamber.

13. The apparatus of claim 8, further comprising means associated with said inlet for uniformly distributing said bulk material.

14. The apparatus of claim 13, wherein said means for uniformly distributing includes a distributing plate.

15. Apparatus for heating electrically conductive bulk materials by means of resistance heating comprising an inlet; an outlet; end and side walls, arranged between said inlet and said outlet, forming an oven chamber; at least two pairs of generally planar electrodes, the members of each pair being mounted to opposed end walls, a plurality of said electrodes being displaced from said end walls toward the interior of said oven chamber, and a plurality of said electrodes including elongated portions extending from the planar portion of said electrodes toward the interior of said oven chamber.

16. The apparatus of claim 15 wherein the position of the interiormost end of at least one of said elongated portions is adjustable.

17. Apparatus for heating electrically conductive bulk materials by means of resistance heating comprising an inlet; an outlet; end and side walls, arranged between said inlet and said outlet, forming an oven chamber; at least two pairs of electrodes, the members of each pair being mounted to opposed end walls; means for controlling the spatial distribution of heating of said bulk materials, wherein said bulk material flowing into the oven chamber through the inlet tends to form a pouring-in cone, said spatial distribution controlling means including at least one pair of said electrodes which contact said bulk material in said pouring-in cone.

18. The apparatus of claim 17 wherein said electrodes comprise elongated portions which are inclined at angles so that their ends nearest the center of said oven chamber are higher than their other ends.

19. The apparatus of claim 17 wherein the walls of said oven chamber taper inwardly as they approach the inlet, electrodes being mounted on the inwardly tapering walls.

* * * * *